United States Patent [19]

Beret et al.

[11] Patent Number: 4,761,220

[45] Date of Patent: Aug. 2, 1988

[54] HYDROPROCESSING CATALYST FINES AS A FIRST-STAGE CATALYST IN A TWO-STAGE, CLOSE-COUPLED THERMAL CATALYTIC HYDROCONVERSION PROCESS

[75] Inventors: Samil Beret, Danville; S. Gary Yu, Oakland; C. Richard Hsieh, San Rafael, all of Calif.

[73] Assignee: Chevron Research Company, San Francisco, Calif.

[21] Appl. No.: 667,503

[22] Filed: Oct. 31, 1984

[51] Int. Cl.[4] ..... C10G 65/12

[52] U.S. Cl. ..... 208/59; 208/89; 208/211; 208/251 H

[58] Field of Search ..... 208/59, 89, 211, 251 H

[56] References Cited

U.S. PATENT DOCUMENTS

| | | | |
|---|---|---|---|
| 2,771,401 | 11/1956 | Shepherd | 208/210 |
| 3,166,493 | 1/1965 | Harvey | 208/89 |
| 3,901,792 | 8/1975 | Wolk et al. | 208/210 |
| 3,933,624 | 1/1976 | Myers | 208/253 |
| 4,147,617 | 4/1979 | Nace | 208/74 |
| 4,501,652 | 2/1985 | Le et al. | 208/57 |
| 4,559,129 | 12/1985 | Reynolds et al. | 208/59 |
| 4,559,130 | 12/1985 | Reynolds et al. | 208/59 |
| 4,560,465 | 12/1985 | Yu et al. | 208/59 |
| 4,564,439 | 1/1986 | Kuehler et al. | 208/59 |

*Primary Examiner*—Olik Chaudhuri

*Attorney, Agent, or Firm*—S. R. La Paglia; W. K. Turner; Q. Todd Dickinson

[57] ABSTRACT

A process for the production of transportation fuels from heavy hydrocarbonaceous feedstock is provided comprising a two-stage, close-coupled process, wherein the first stage comprises a hydrothermal zone into which is introduced a mixture comprising a feedstock and finely ground hydroprocessing catalyst having coke-suppressing and demetalizing activity, and hydrogen; and the second, close-coupled stage comprises a hydrocatalytic zone into which substantially all the effluent from the first stage is directly passed and processed under hydrocracking conditions. The first-stage ground catalyst may also be spent catalyst from which most metals have been removed.

20 Claims, No Drawings

HYDROPROCESSING CATALYST FINES AS A FIRST-STAGE CATALYST IN A TWO-STAGE, CLOSE-COUPLED THERMAL CATALYTIC HYDROCONVERSION PROCESS

BACKGROUND OF THE INVENTION

The present invention relates to a process for the hydroconversion of heavy hydrocarbonaceous fractions of petroleum. In particular, it relates to the use of catalyst fines, particularly spent fines, as a first-stage catalyst in a close-coupled, two-stage process for the hydrothermal and hydrocatalytic conversion of petroleum residua having improved effectiveness for demetalation, heteroatom removal, and inhibition of adverse coke formation in the first stage.

Increasingly, petroleum refiners find a need to make use of heavier or poorer quality crude feedstocks in their processing. As that need increases, the need also grows to process the fractions of those poorer feedstocks boiling at elevated temperatures, particularly above 1000° F., which contain increasingly high levels of undesirable metals, sulfur, and coke-forming precursors like asphaltenes. These contaminants significantly interfere with the hydroprocessing of these heavier fractions by ordinary hydroprocessing means. These contaminants are widely present in petroleum crude oils and other heavy petroleum hydrocarbon streams, such as petroleum hydrocarbon residua and hydrocarbon streams derived from coal processing and atmospheric or vacuum distillations. The most common metal contaminants found in these hydrocarbon fractions include nickel, vanadium, and iron. The various metals deposit themselves on hydrocracking catalysts, tending to poison or deactivate those catalysts. Additionally, metals and asphaltenes and coke precursors can cause interstitial plugging of catalyst beds and reduce catalyst life. Such deactivated or plugged catalyst beds are subject to premature replacement.

Additionally, in two-stage processes similar to this, thermal hydrotreating reactors are very susceptible to the adverse formation of coke on various components of the reactor. In particular, it has been found that coke builds up significantly on the walls of the reactor and that this coke build-up, if unchecked, will eventually cause the reactor to plug up, thereby necessitating time-consuming and expensive rehabilitation. It is the intention of the present invention to overcome these problems by using a two-stage, close-coupled process, wherein the action of finely ground catalyst acts as a particularly effective catalyst and contact particle in a first-stage hydrothermal reactor to induce demetalation and some hydroconversion and to suppress adverse coke formation within the reactor, particularly on the reactor walls. The treated effluent from the first stage is then passed, close-coupled to a second-stage hydrocatalytic reactor where it is hydroprocessed to produce high yields of transportation fuel.

PRIOR ART

Various processes for the conversion of heavy hydrocarbonaceous fractions, particularly, multi-stage conversion processes include U.S. Pat. No. 4,366,047, Winter et al.; U.S. Pat. No. 4,110,192, Hildebrand et al.; U.S. Pat. No. 4,017,379, Iida et al.; U.S. Pat. No. 3,365,389, Spars et al.; U.S. Pat. No. 3,293,169 Kozlowski; U.S. Pat. No. 3,288,703, Spars et al.; U.S. Pat. No. 3,050,459, Shuman; U.S. Pat. No. 2,987,467, Keith et al.; U.S. Pat. No. 2,956,002, Folkins; and U.S. Pat. No. 2,706,705, Oettinger et al. Other processes similar to this invention but using different first-stage catalytic agents include currently pending applications U.S. Ser. No. 625,937, filed June 29, 1984; U.S. Ser. No. 644,737, filed Aug. 27, 1984; U.S. Ser. No. 644,738, filed Aug. 27, 1984; and U.S. Ser. No. 644,739, filed Aug. 27, 1984.

SUMMARY OF THE INVENTION

In accordance with the present invention, there is provided a two-stage, close-coupled process for the hydroprocessing of a heavy hydrocarbonaceous feedstock into transportation fuels boiling below 650° F. At least 30 volume percent of the feedstock boils above 1000° F. and the feedstock contains greater than 100 parts per million by weight of total metal contaminants.

The process comprises introducing a mixture comprising the feedstock and finely ground catalyst fines, particularly spent catalyst fines from which most of the metals have been recovered by roasting and leaching, but which have sufficient catalytic activity to suppress adverse coke formation under incipient coking conditions and induce demetalation, into a first-stage hydrothermal zone in the presence of hydrogen. The feedstock and fines mixture is introduced into the hydrothermal zone preferably in an upward, essentially plug flow configuration, under conditions sufficient to substantially demetalate the feedstock and to convert a significant amount of hydrocarbons boiling above 1000° F. to hydrocarbons boiling below 1000° F.

It has been found that using catalyst fines results in improved first-stage conditioning and process yields over the prior art catalyst, in particular the use of the aluminum processing mineral waste, red mud. The use of spent catalyst fines is particularly advantageous economically, as they have little intrinsic value after metals removal and constitute a disposal problem, a problem this invention also helps to overcome.

Substantially all or at least a substantial portion of the effluents of the first-stage hydrothermal zone is rapidly passed directly and preferably upflow, in a close-coupled manner, into a second-stage catalytic reaction zone at a reduced temperature relative to the first-stage hydrothermal zone. The effluent is contacted with hydroprocessing catalysts under hydroprocessing conditions, and the effluent from said second-stage catalytic reaction zone is recovered.

Alternatively, the catalyst fines are dispersed within the hydrocarbonaceous feedstock, hydrogen is added, and the resultant dispersion is heated to a temperature between 750° F. to 900° F. The heated dispersion is then introduced into the first-stage hydrothermal zone in an upward, essentially plug flow configuration, and the processing proceeds as summarized above.

DETAILED DESCRIPTION OF THE INVENTION

The present invention is directed to the use of hydroprocessing catalyst fines, either fresh or spent, as first-stage catalytic contact particles in a process for the hydroprocessing of heavy hydrocarbonaceous feedstocks, a significant portion of which boils above 1000° F., to produce high yields of transportation fuels boiling below 650° F. The process is a two-stage, close-coupled process, the first stage of which encompasses a hydrothermal treating zone, wherein the feedstock is substantially demetalated while at the same time adverse coke formation is reduced, particularly on the reactor walls, by using the aforementioned catalyst fines as a catalytic agent and contact particle in the first stage. It is also anticipated that some hydrogenation may occur in the first-stage hydrothermal zone. The hydrothermally treated feedstock is then passed directly and without substantial loss of hydrogen partial pressure into a hydrocatalytic treatment zone, wherein the hydrothermal zone effluent is catalytically treated to produce an effluent suitable for further treatment into transportation fuels.

The feedstock finding particular use within the scope of this invention is any heavy hydrocarbonaceous feedstock, at least 30 volume percent of which boils above 1000° F. and which has greater than 100 parts per million by weight total metallic contaminants. Examples of typical feedstocks include crude petroleum, topped crude petroleum, reduced crudes, petroleum residua from atmospheric or vacuum distillations, vacuum gas oils, solvent deasphalted tars and oils, and heavy hydrocarbonaceous liquids including residua derived from coal, bitumen, or coal tar pitches.

The heavy hydrocarbonaceous feedstocks finding particular use in this invention contain very high and undesirable amounts of metallic contaminants. While various metals or soluble metal compounds may be present in the feedstock, the most debilitating include nickel, vanadium, and iron. These metallic contaminants cause hydroprocessing catalysts to deteriorate rapidly as well as adversely affecting selectivity and catalyst life. Depending on the metal, the contaminants can enter the catalyst pores (nickel and vanadium) or plug the interstices in the catalyst particles (iron). The result is deactivation of the catalyst, and/or an increase in the pressure drop in a fixed bed reactor due to plugging.

Thermal hydroprocessing of the heavy feedstocks of the present invention also gives rise to significant and undesirable amounts of adverse coke formation particular on the surfaces of the reactor, and more particularly on the walls of the reaction vessel. It has been found that using the catalyst fines of the present invention, particularly acting as high surface area contact particles, significantly reduces the coke formation in a thermal reactor, especially on the walls, and that the coke that is formed deposits on the particles themselves instead of the reactor walls and is thereoy removed from the reactor. If not removed, the coke will build up and eventually plug the reactor. The precipitation of asphaltenes and other coke precursors is also significantly reduced using catalyst fines in the thermal stage.

In the preferred embodiment of the present invention, the catalyst fines are mixed with the heavy hydrocarbonaceous feed to form a slurry, preferably a dispersion or uniform distribution of particles within the feed, which is introduced into a first-stage thermal reactor.

The catalyst fines of this invention improve the process relative to the prior art because of their selectivity in treating the feedstock in the thermal stage. One mechanism for this is believed to be the increased hydrogenative activity at low concentrations, as well as increased heteroatom removal and demetalation in the first stage. This results in improved product quality, extended second-stage life, and the avoidance of product stability problems.

The hydrogenation components contained in the catalyst can be any of a number of metals which are ordinarily used in hydroprocessing catalysts, but especially those transition metals in Group VI and Group VIII of the Periodic Table. These include molybdenum, cobalt, nickel, tungsten, etc. These may be on any suitable refractory base such as alumina, silica, titania, boria, zirconia, magnesia, clays, or mixtures thereof. These hydrogenation components combined with the high surface area base are believed to be primarily responsible for the enhanced hydrogenation.

These hydrogenative effects are also significant using spent catalyst fines as opposed to ground fresh catalyst. Spent catalysts include hydroprocessing catalysts which have been used for regular hydroprocessing and whose catalytic activity has dropped below certain activity limits. Their deactivation is chiefly caused by metals deposited in their pores. Using these spent catalysts in the present invention also helps solve the disposal problem inherent in their production.

Spent catalyst may be used directly as it comes from the hydroprocessing unit, containing residual carbon and pore-clogging metal contaminants. More preferably, it is roasted to remove the residual carbon and used, or further processed by leaching with mineral acid to recover valuable metals entrained within it, such as cobalt and molybdenum. The spent catalyst is then crushed and ground fine. Even after metals removal, the fines contain hydrogenation and cracking components concentration of around 1.0 to 2.0 percent, sufficient for the purposes of the invention.

The specific composition of the catalyst fines varies with the type of catalyst used. One preferred catalyst finding use in the present invention contains from about 1 to 10 percent by weight of a Group VIII metal oxide and from 5 to 25 percent of a Group VI metal oxide, more preferably nickel oxide and molybdenum or tungsten oxide, respectively. One preferred embodiment contains 3.2 to 3.6 percent (3.4 avg.) nickel, and 11.4 to 12.6 percent (12.0 avg.) molybdenum. These would be present as the oxides at levels of 4.3 percent and 18.0 percent, respectively. They would ordinarily be present on an alumina base.

As stated, the catalyst fines may be either fresh or spent catalyst which has been crushed and ground suitably fine such that the available surface area is greatly increased. The preferred particle size is 200 mesh U.S. sieve series or less, with an average diameter of from about 5 microns to 75 microns. The catalyst fines are present in the feedstock/fines mixture in a concentration relative to the feedstock of from about 0.1 percent by weight to about 2.0 percent by weight, and preferably from about 0.25 percent to 0.5 percent.

In an alternative embodiment, the catalyst fines may be presulfided prior to their addition to the system. Preferably they will be sulfided by pretreating with a sulfiding agent, such as hydrogen sulfide, in an elevated temperature reactor. A method of presulfiding a first-stage catalyst finding use in the present invention is detailed in U.S. Ser. No. 644,738, incorporated herein by reference.

The feedstock-catalyst fines mixture is introduced into the first-stage hydrothermal zone. Hydrogen is also introduced, either cocurrently or countercurrently, to the flow of the feedstock-fines slurry, and may constitute either fresh hydrogen, recycled gas, or a mixture thereof. The reactant mixture is then heated to a temperature of between 750° F. to 900° F., preferably 800° F. to 850° F. The feed may flow upwardly or downwardly in the hydrothermal reaction zone, but it is preferable that it flow upwardly. Preferably, the hydrothermal zone is configured such that plug flow conditions are approached.

Other reaction conditions in the hydrothermal zone include a residence time of from 0.01 to 3 hours, preferably 0.5 to 1.5 hours; a pressure in the range of 35 to 680 atmospheres, preferably 100 to 340 atmospheres, and more preferably 100 to 200 atmospheres; and a hydrogen gas rate of 355 to 3550 liters per liter of feed mixture and preferably 380 to 1780 liters per liter of feed mixture. Under these conditions, the feedstock is substantially demetalated and a significant amount of the hydrocarbons in the feedstock boiling above 1000° F. are converted to hydrocarbons boiling below 1000° F. In the preferred embodiment, the significant amount of hydrocarbons boiling above 1000° F. to those boiling below 1000° F. is at least 80 percent, more preferably 85 percent to 95 percent.

The effluent from the hydrothermal reactor zone is directly and rapidly passed into a second-stage catalytic reaction zone. In this invention, the two primary stages or zones are close-coupled, referring to the connective relationship between those zones. In this close-coupled system, the hydrogen pressure between the hydrothermal zone and the hydrocatalytic zone is maintained such that there is no substantial loss of hydrogen partial pressure through the system. In a close-coupled system also, there is preferably no solids separation effected on the feed as it passes from one zone to tne other, and there is no more cooling and reheating than necessary. However, it is preferred to cool the first-stage effluent by passing it through a cooling zone prior to the second stage. This cooling does not affect tne close-coupled nature of the system. The cooling zone will typically contain a heat exchanger or similar means, whereby the effluent from the hydrothermal reactor zone is cooled to a temperature between at least 15° F. to 200° F. below that of the temperature of the hydrothermal zone. Some cooling may also be effected by the addition of fresh, cold hydrogen if desired.

It may also be desirable to subject the effluent to a high pressure flash between stages. In this procedure, the first-stage effluent is run into a flash vessel operating under reaction conditions. Separated vapors are removed and the flash bottoms are sent to the cooling zone to reduce the temperature of the first-stage effluent. Additional hydrogen may be added. Again, as the flash is still carried out with no substantial loss of hydrogen pressure through the system, the close-coupled nature of the system is maintained.

The catalytic reaction zone is preferably a fixed bed type, but an ebullating or moving bed may also be used. While it is preferable that the mixture pass upward to the reaction zone to reduce catalyst fouling by the solid particulate, the mixture may also pass downwardly.

The catalyst used in the hydrocatalytic zone may be any of the well-known, commercially available hydroprocessing catalysts. A suitable catalyst for use in the hydrocatalytic reaction zone comprises a hydrogenation component supported on a suitable refractory base. Suitable bases include silica, alumina, or composite of two or more refractory oxides such as silica-alumina, silica-magnesia, silica-zirconia, alumina-boria, silica-titania, silica-zirconia-titania, acid-treated clays, and the like. Acidic metal phosphates such as alumina phosphate may also be used. The preferred refractory bases include alumina and composites of silica and alumina. Suitable hydrogenation components are selected from Group VI metals, Group VIII metals and their oxides, or mixture thereof. Particularly useful are cobalt-molybdenum, nickel-molybdenum, or nickel-tungsten on silica-alumina supports.

In the hydrocatalytic reaction zone, hydrogenation and cracking occur simultaneously, and the higher-molecular-weight compounds are converted to lower-molecular-weight compounds. The products will also have been substantially desulfurized, denitrified, and deoxygenated.

In the process parameters of the hydrocatalytic zone, it is preferred to maintain the temperature below 800° F., preferably in the range of 650° F. to 800° F., and more preferably between 650° F. to 750° F. to prevent catalyst fouling. Other hydrocatalytic conditions include a pressure from 35 atmospheres to 680 atmospheres, preferably 100 atmospheres to 340 atmospheres; a hydrogen gas rate of 355 to 3550 liters per liter of feed mixture, preferably 380 to 1780 liters per liter of feed mixture; and a feed-liquid hourly space velocity in the range of 0.1 to 2, preferably 0.2 to 0.5.

Preferably, the entire effluent from the hydrothermal zone is passed to the hydrocatalytic zone. However, since small quantities of water and light gases ($C_1$ to $C_4$) are produced in the hydrothermal zone, the catalyst in the second stage may be subjected to a slightly lower hydrogen partial pressure than if these materials were absent. Since higher hydrogen partial pressures tend to increase catalyst life and maintain the close-coupled nature of the system, it may be desired in a commercial operation to remove a portion of the water and light gases before the stream enters the hydrocatalytic stage. Furthermore, interstage removal of the carbon monoxide and other oxygen-containing gases may reduce the hydrogen consumption in the hydrocatalytic stage due to the reduction of carbon oxides.

The product effluent from the hydrocatalytic reaction zone may be separated into a gaseous fraction and a solids-liquids fraction. The gaseous fraction comprises light oils boiling below about 150° F. to 270° F. and normally gaseous components such as hydrogen, carbon monoxide, carbon dioxide, water, and the $C_1$ to $C_4$ hydrocarbons. Preferably, the hydrogen is separated from the other gaseous components and recycled to the hydrothermal or hydrocatalytic stages. The solids-liquids fraction may be fed to a solids separation zone, wherein the insoluble solids are separated from the liquid by conventional means, for example, hydroclones, filters, centrifugal separators, high gradient magnetic filtration, cokers and gravity settlers, or any combination of these means.

The process of the present invention produces extremely clean, normally liquid products suitable for use as transportation fuels, a significant portion of which boils below 650° F. The normally liquid products, that is, all of the product fractions boiling above $C_4$, have a specific gravity in the range of naturally occurring petroleum stocks. Additionally, the product will have at least 80 percent of sulfur removed and at least 30 percent of nitrogen. The process may be adjusted to produce the type of liquid products that are desired in a particular boiling point range. Additionally, those products boiling in the transportation fuel range may require additional upgrading or clean up prior to use as a transportation fuel.

The following examples demonstrate the synergistic effects of the present invention and are presented to illustrate a specific embodiment of the practice of this invention and should not be interpreted as a limitation upon the scope of that invention.

Additionally, the results of some of the examples and comparative examples listed in the subsequent Tables (where noted) were taken from inspections of the liquid effluent of the first-stage hydrothermal zone in order to demonstrate more distinctly the effectiveness of the present invention. Had they been processed, close-coupled, through the second-stage hydrocatalytic zone, the distinction between the comparative catalysts as shown by the product composition would not be as sharp for purposes of demonstrating the effectiveness of the process. The effect on the second-stage catalyst life and the amount required for effective conversion, as well as the increased amenability of the first-stage products to second-stage catalytic processing remains the distinctive advantages. For comparison purposes, second-stage results are also included, where noted.

EXAMPLES

Example 1

A slurry of 2.0 percent fresh hydroprocessing catalyst fines, crushed and ground to a minimum of 200 mesh U.S. sieve series, and Santa Maria 700° F.+ crude feedstock was prepared. The catalyst fines had the following composition: 4.3 percent by weight NiO, 18.0 percent by weight $MoO_3$ (equivalent to 3.4 percent Ni and 12.0 percent Mo), with the balance primarily alumina. The slurry was processed in an upflow, thermal reactor at 850° F., 1 SHSV, 1500 psia, and 10,000 SCF/Bbl $H_2$ circulation gas rate. Samples were taken through a high pressure let down system prior to second-stage processing. The liquid product inspection is noted in Table I.

Example 2

A slurry of 2.0 percent red mud (prepared as discussed below) and Santa Maria 700° F.+ feedstock was processed according to the process of Example 3. The liquid product inspection is listed in Table I.

Example 3

A slurry of 0.25 percent hydroprocessing catalyst fines of the same composition as in Example 1 and Hondo Atmospheric Residuum (AR) was prepared and processed in an upflow, thermal reactor at 825° F., 1 SHSV, 2400 psia, and 10,000 SCF/Bbl $H_2$ circulation gas rate. The effluent was passed close-coupled to a fixed bed hydrocatalytic reactor using a Nickel/Molybdenum catalyst at 720° F., 0.4 SHSV, 2400 psia, and 10,000 SCF/Bbl circulation. The liquid product inspection of the second-stage effluent is listed in Table I.

Example 4

A slurry of 0.25 percent red mud (prepared as below) and Hondo AR 850° F.+ was prepared and processed as in Example 3. The liquid product inspection is listed in Table I.

TABLE I

| | Example | | | |
|---|---|---|---|---|
| | 1 | 2 | 3 | 4 |
| First-stage Catalyst | Catalyst fines | Red mud | Catalyst fines | Red mud |
| % Catalyst (by weight) | 2.0 | 2.0 | 0.25 | 0.25 |
| Feed | Santa Maria | Santa Maria | Hondo AR | Hondo AR |

TABLE I-continued

| | Example | | | |
|---|---|---|---|---|
| | 1 | 2 | 3 | 4 |
| °API | 24.7 | 21.7 | 28.8 | 28.9 |
| Product Inspection: ($C_4$ + liquid) | | | | |
| Sulfur (%) | 2.1 | 2.8 | 0.17 | 0.20 |
| Nitrogen (%) | 0.85 | 0.94 | 0.45 | 0.49 |
| H/C (atomic) | 1.61 | 1.58 | 1.73 | 1.72 |
| Ni (ppm) | 69 | 92 | — | — |
| V (ppm) | 93 | 109 | — | — |

Example 5

Spent cobalt/molybdenum catalyst from an RDS unit was roasted to burn off coke and leached with mineral acid to recover most of the cobalt and molybdenum. After the leaching, the catalyst contained about 1 percent metals. The catalyst was crushed and ground to 200 mesh minus, U.S. sieve series. A slurry of 0.5 percent by weight of the spent, ground catalyst fines and Kern 950° F.+ Vacuum Residuum (VR) was prepared and processed in an upflow, thermal reactor at 825° F., 1 SHSV, 2400 psia, 10,000 SCF/Bbl circulation. The effluent was passed close-coupled to a fixed bed hydrocatalytic reactor using a Ni/Mo hydroprocessing catalyst at 720° F., 0.4 SHSV, 2400 psia, and 10,000 SCF/Bbl.

The liquid product inspection of the secondstage effluent is listed in Table II.

Example 6

A slurry of 0.25 percent red mud, prepared as discussed below, and Kern VR feedstock was processed according to the process of Example 5. The liquid product inspection is listed in Table II.

Example 7

A slurry of 0.25 percent spent, leached, roasted and ground catalyst, prepared as in Example 5, and Santa Maria 700? F.+ feedstock was prepared and processed as in Example 5. The liquid product inspection is listed in Table II.

Example 8

A slurry of 0.25 percent red mud, prepared as discussed below, and Santa Maria 700? F.+ feedstock was prepared and processed as in Example 5. The liquid product inspection is listed in Table II.

TABLE II

| | Example | | | |
|---|---|---|---|---|
| | 5 | 6 | 7 | 8 |
| First-stage Catalyst | Spent Catalyst Fines | Red Mud | Spent Catalyst Fines | Red Mud |
| % Catalyst (by weight) | .5 | .5 | .25 | .25 |
| Feed | Kern VR | Kern VR | Santa Maria | Santa Maria |
| °API | 23.3 | 20.8 | | |
| H/C (atomic) | 1.63 | 1.63 | 1.74 | 1.72 |
| Boiling Pt. Distrib., Vol. % | | | | |
| 650° F.− | 36.3 | 32.6 | 60 | 47 |
| 650–1000° F. | 43.3 | 39.4 | 29 | 41 |
| 1000° F.+ | 20.5 | 27.9 | 11 | 12 |
| Product Inspection: | | | | |

TABLE II-continued

| | Example | | | |
|---|---|---|---|---|
| | 5 | 6 | 7 | 8 |
| Sulfur (%) | 0.043 | 0.075 | — | — |
| Nitrogen (%) | 0.72 | 0.81 | — | — |
| N/V/Fe ppm | 15/4/3 | 27/12/3 | — | — |
| Conversion | | | | |
| $650^+/650^-$ | 33 | 31 | — | — |
| $1000^+/1000^-$ | 77 | 68 | — | — |

Preparation of Red Mud

Red mud, a by-product from the aluminum industry Bayer process, was prepared by drying in a vacuum drying oven at 200°-250° F. under an $N_2$ bleed for 1 to 24 hours. The water content was reduced from 30 to 50% (as received) to 1 to 5%. After the dried material cooled, it was pulverized in a hammer mill and screened to 60 mesh minus to 100 mesh minus U.S. standard sieve size. The resultant material was used immediately or stored under dry $N_2$ until use.

Alternatively, the red mud is wet-screened to 60 mesh minus to 100 mesh minus U.S. standard sieve size. The slurry was allowed to settle, and the supernatent liquid was withdrawn. The wet-screened red mud was used directly.

What is claimed is:

1. A two -stage, close-coupled process for hydroprocessing a heavy hydrocabonaceous feedstock at least 30 volume percent of which boils above 1000° F. and which has greater than 100 parts per million by weight total metal contaminants to produce high yields of transportation fuels boiling below 650° F., which comprises:

(a) introducing said feedstock and finely ground spent hydroprocessing catalyst particles having activity sufficient to suppress adverse coke formation under coking coditions and having demetallizing activity, into a first-stage hydrothermal zone in the presence of hydrogen; wherein said feedstock and catalyst particles are introduced into said hydrothermal zone under conditions sufficient to substantially demetalate said feedstock and to convert a significant amount of the hydrocarbons in said feedstock boiling above 1000° F. to hydrocarbons boiling below 1000° F.;

(b) rapidly and without substantial reduction of pressure through the system passing a substantial portion of the substantially demetalated, spent catalyst particle-entrained effluent of said first-stage hydrothermal zone directly into a second-stage catalytic reaction zone at a reduced temperature relative to said first-stage hydrothermal zone and contacting said effluent with hydroprocessing catalyst under hydroprocessing conditions, including a temperature in the range of 650° F. to 800° F.; and (c) recovering the effluent from said catalytic reator zone.

2. A two-stage, close-coupled process for hydroprocessing a heavy hydrocarbonaceous feedstock at least 30 volume percent of which boils above 1000° F. and which has greater than 100 parts per million by weight total metal contaminants to produce high yields of transportation fuels boiling below 650° F., which comprises:

(a) forming a slurry by dispersing within said feedstock, finely ground spent hydroprocessing catalyst particles having formation under coking conditions and having demetalizing activity, in the presence of hydrogen;

(b) introducing said slurry into a first-stage hydrothermal zone under conditions sufficient to substantially demetalate said feedstock and to convert a significant amount of the hydrocarbons is said feedstock boiling above 1000° F. to hydrocarbons boiling below 1000° F.;

(c) rapidly, and without substantial reduction of pressure through the system, passing a substantial portion of the substantially demetalated, spent catalyst particle-entrained effluent of said first-stage hydrothermal zone directly into a second-stage catalytic reaction zone at a reduced temperature relative to said first-stage hydrothermal zone, and contacting said effluent with hydorprocessing catalyst under hydroprocessing conditions, including a temperature in the range of 650° F. to 800° F.; and (d) recovering the effluent from said catalytic reaction zone.

3. The process as claimed in claim 1 or 2 wherein substantially all of the effluent from said first-stage hydrothermal zone is passed into said second-stage catalytic reaction zone.

4. The process as claimed in claim 1 or 2 wherein the concentration of residual metals in said spent catalytic particles is about 1 percent by weight or less.

5. The process as claimed in claim 1 or 2 wherein said hydroprocessing catalyst particles contain at least one hydrogenation component selected from Group VI or Group VIII of the Periodic Table.

6. The process as claimed in claim 4 wherein said hydroprocessing catalyst particles contain at least one hydrogenation component selected from Group VI or Group VIII of the Periodic Table.

7. The process as claimed in claim 1 or 2 wherein the temperature of said first-stage hydrothermal zone is maintained within a range of between 750° F. to 900° F.

8. The process as claimed in claim 7 wherein the temperature of said second-stage zone is between 15° F. to 200° F. below that of said first-stage zone.

9. The process as claimed in claim 1 or 2 wherein the particle size of the particles of said catalyst particles is less than 200 mesh U.S. standard sieve size.

10. The process as claimed in claim 1 or 2 wherein said feedstock-ground catalytic particle mixture is introduced into said hydrothermal zone in an upward, essentially plug flow manner, and the effluent of said first-stage zone is introduced into said catalytic zone in an upward manner.

11. The process as claimed in claim 1 or 2 wherein said amount of hydrocarbons in the feedstock boiling above 1000° F. which is converted to, hydrocarbons boiling below 1000° F. is at least 80 percent.

12. The process as claimed in claim 1 or 2 wherein said metal contaminants in the feedstock include nickel, vanadium, iron.

13. The process as claimed in claim 1 or 2 wherein said heavy hydrocarbonaceous feedstock is crude petroleum, topped crude petroleum, reduced crudes, petroleum residua from atmospheric or vacuum distillations, vacuum gas oils, solvent deasphalted tars and oils, and heavy hydrocarbonaceous liquids derived from coal, bitumen, or coal tar pitches.

14. The process as claimed in claim 1 or 2 wherein the concentration of said ground catalyst particles within said feedstock is from 0.1 to 2.0 percent by weight.

15. The process as claimed in claim 14 wherein said ground catalytic particle concentration is less than 1 percent by weight.

16. The process as claimed in claim 1 or 2 wherein the catalyst in said second-stage catalytic reaction zone is maintained in a supported bed within the reaction zone.

17. The process as claimed in claim 1 or 2 wherein the process is maintained at a hydrogen partlal pressure from 35 atmospheres to 680 atmospheres.

18. The process as claimed in claim 17 wherein the hydrogen partial pressure is maintained between 100 atmospheres to 340 atmospheres.

19. The process as claimed in claim 1 or 2 wherein a substantial portion of the hydroprocessing catalyst in the catalytic reaction zone is a hydrocracking catalyst comprising at least one hydrogenation component selected from Group VI or Group VIII of the Periodic Table, and is supported on a refractory base.

20. The process as claimed in claim 1 or 2 wherein the ground catalyst has been presulfided.

* * * * *

UNITED STATES PATENT AND TRADEMARK OFFICE

CERTIFICATE OF CORRECTION

PATENT NO. : 4,761,220

DATED : August 2, 1988

INVENTOR(S) : Samil Beret et al

It is certified that error appears in the above-identified patent and that said Letters Patent are hereby corrected as shown below:

| | |
|---|---|
| Claim 1, Col. 9, line 29, | "hydrocabonaceous feedstock" should read --hydrocarbonaceous feedstock-- |
| Claim 1, Col. 9, line 38, | "coking coditions" should read --coking conditions-- |
| Claim 2 (a) Col. 9, line 68, | "having formation under" should read --having activity sufficient to suppress adverse coke formation under-- |
| Claim 2 (b) Col. 10, line 6, | "hydrocarbons is" should read --hydrocarbons in-- |
| Claim 2 (c) Col. 10, line 16 | "hydorprocessing catalyst" should read --hydroprocessing catalyst-- |
| Claim 11, Col. 10, line 3, | "to, hydrocarbons" should read --to hydrocarbons-- |

UNITED STATES PATENT AND TRADEMARK OFFICE

CERTIFICATE OF CORRECTION

PATENT NO. : 4,761,220

DATED : August 2, 1988

INVENTOR(S) : Samil Beret et al

It is certified that error appears in the above-identified patent and that said Letters Patent is hereby corrected as shown below:

Claim 17, Col. 11, line 2, "partlal pressure" should read --partial pressure--

Signed and Sealed this

Twenty-fourth Day of January, 1989

*Attest:*

DONALD J. QUIGG

*Attesting Officer*

*Commissioner of Patents and Trademarks*